United States Patent [19]

Batteux

[11] Patent Number: 4,466,691

[45] Date of Patent: Aug. 21, 1984

[54] CONNECTING TERMINAL FOR CIRCUIT INTERRUPTER

[75] Inventor: Pierre Batteux, St. Pierre de Mesage, France

[73] Assignee: Merlin Gerin, Grenoble, France

[21] Appl. No.: 415,995

[22] Filed: Sep. 8, 1982

[30] Foreign Application Priority Data

Oct. 5, 1981 [FR] France ..... 81 18839

[51] Int. Cl.[3] ..... H01R 4/36

[52] U.S. Cl. ..... 339/272 R

[58] Field of Search ..... 339/272; 337/70

[56] References Cited

U.S. PATENT DOCUMENTS

| | | | |
|---|---|---|---|
| 1,266,440 | 5/1918 | Finkelstein | 339/272 R |
| 2,088,481 | 7/1937 | Mylius | 339/272 UC |
| 2,148,960 | 2/1939 | Peirce | 24/243 |
| 3,086,194 | 4/1963 | Price | 339/272 R |
| 3,144,293 | 8/1964 | De Smidt | 339/272 R |
| 3,355,685 | 11/1967 | Leonard | 337/70 |
| 3,374,456 | 3/1968 | Evans | 339/272 R |
| 3,693,138 | 9/1972 | Pertuit | 339/272 A |
| 4,199,216 | 4/1980 | Gryctko | 339/272 R |

FOREIGN PATENT DOCUMENTS

| | | | |
|---|---|---|---|
| 2438344 | of 0000 | France . | |
| 2136396 | of 0000 | France . | |
| 985538 | of 0000 | France . | |
| 732342 | of 0000 | France . | |
| 1128425 | 9/1968 | United Kingdom | 339/272 R |

*Primary Examiner*—Joseph H. McGlynn
*Assistant Examiner*—David L. Pirlot
*Attorney, Agent, or Firm*—Parkhurst & Oliff

[57] ABSTRACT

The invention relates to a terminal likely to receive two superposed conductors or cables. Between the cables is inserted an intermediate setscrew likely to shift axially by being fixed in rotation so as to transmit to the lower cable a retightening stress exerted by rotation of the upper screw after some development time.

3 Claims, 4 Drawing Figures

CONNECTING TERMINAL FOR CIRCUIT INTERRUPTER

BACKGROUND AND SUMMARY OF THE INVENTION

The invention relates to a cable clamp terminal for the connection of conducting cables to an electrical apparatus for instance to a circuit interrupter having a terminal block with two superposed housings or sockets, each of them disposed to receive the end of a cable and two set screws likely to be screwed into a tapped aperture of said block crosswise extending to said housings. The intermediate one of the screws tightens the cable inserted in the lower housing between the bottom and the intermediate screw and the other upper one tightens the cable inserted in the upper housing between the intermediate screw and the upper screw.

For certain applications it is necessary to connect to each terminal of an electrical apparatus, in particular of a high power circuit breaker with moulded casing, two cables or conducting wires. A connector in the form of a conducting block fastened on the connection lug of the circuit breaker and showing two juxtaposed holes meant for receiving connection cables was already suggested. The width of this terminal is too big for modern circuit breakers with moulded casing, and to remedy to this disadvantage, a superposed arrangement of two connecting cables was provided, for instance in the circuit breaker according to U.S. Pat. No. 3,355,685. In this case, it is necessary to provide an intermediate setscrew inserted between the two cables, to ensure a proper electrical connection between the cables and the terminal. The terminal being fastened to the circuit breaker lug, the lower cable was first introduced and the intermediate screw tightened wedging this cable against the terminal bottom. The second cable was then introduced and the upper screw comes and wedges the cable between the two screws. After mounting the intermediate screw is no longer accessible and it is then impossible to verify the right tightening of cables or to carryout a retightening taking up a certain stress relief or compression of the cable strands.

An object of the present invention is to remedy to this disadvantage and to permit the realization of a terminal of reduced width for the connection of two superposed conducting cables allowing a later retightening when the cables become loose in their sockets.

According to the present invention, the tapping of the intermediate screw shows a longitudinal play or clearance allowing a limited axial sliding of the intermediate screw fixed in rotation.

The tapping with play or clearance advantageously extends all along the length of the tapped aperture, the corresponding axial play of the two screws having no effect on the upper screw. The threading is advantageously of the square thread type to reduce in addition the side stresses exerted upon the terminal block.

BRIEF DESCRIPTION OF THE DRAWINGS

Other advantages and technical data will more clearly appear from the following description, wherein reference is made to the accompanying drawings, in which.

DETAILED DESCRIPTION OF THE PREFERRED EMBODIMENT

Figure 1:
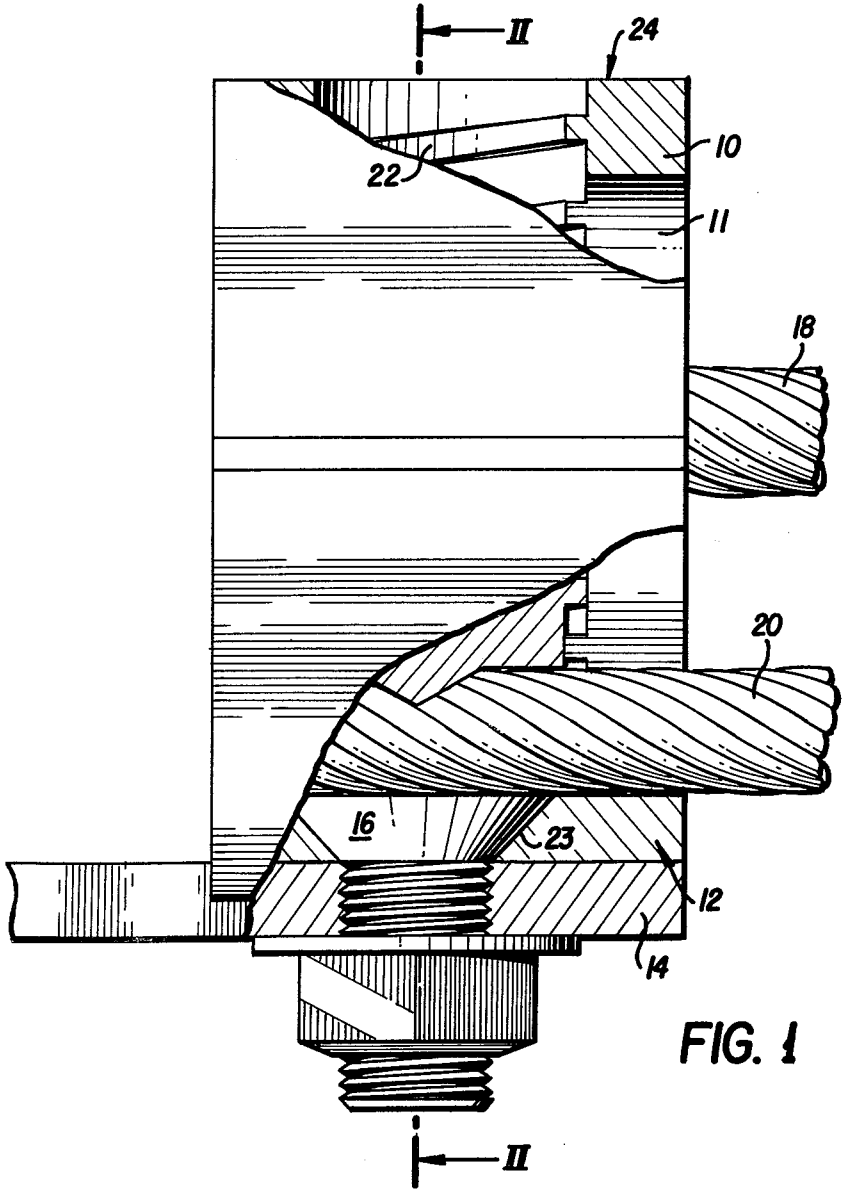
FIG. 1 is an elevational view, partially cut-away, of a terminal according to the invention, fastened on an electrical apparatus lug.

In the figures, a block 10 of a connection terminal in the general form of a parallelipiped shows an elongated slot 11 crossing through and through the block 10. Connections terminals 10 are mounted at opposite ends of the base of a molded-case circuit breaker of the type disclosed in U.S. Pat. No. 3,355,685. The slot 11 width is slightly superior to the cross-section of the cables 18, 20 to connect, the height or length of the slot 11 being sufficient to insert the ends of the two superposed cables 18, 20. The bottom 12 of the block 10 is built on to and fastened on the upper side of an electrical apparatus lug 14 by a fixing bolt 16. The slot 11 extends parallel to the lug 14 and a tapped hole 22, of the block 10, extends perpendicular to the slot 11 according to the longitudinal axis of the block represented on FIG. 1 by the line II—II. The tapped hole 22 opens on the upper side 24 of the block 10 and extends at its base by a reduced cross-section aperture 23 for the passage of the bolt 16. The tapped hole 22 receives two threaded setscrews, an intermediate screw 26 and an upper screw 28. The intermediate screw splits the housing formed by the slot 11 in a lower housing or socket receiving the cable 20 end and in an upper housing admitting the cable 18 end up. The threading of the hole 22 and screws 26, 28 is of the square thread type, the height h of the thread being notably inferior to half of the thread pitch p so as to obtain a notable clearance allowing an axial sliding or back-lash of the screws 26, 28 without rotation of these last ones. The screws 26, 28 show on their upper side an hexagonal recess 30 for inserting a tightening tool and on their lower side a pivot 32 to penetrate between the strands 34 of the cables 18, 20.

Figure 2:
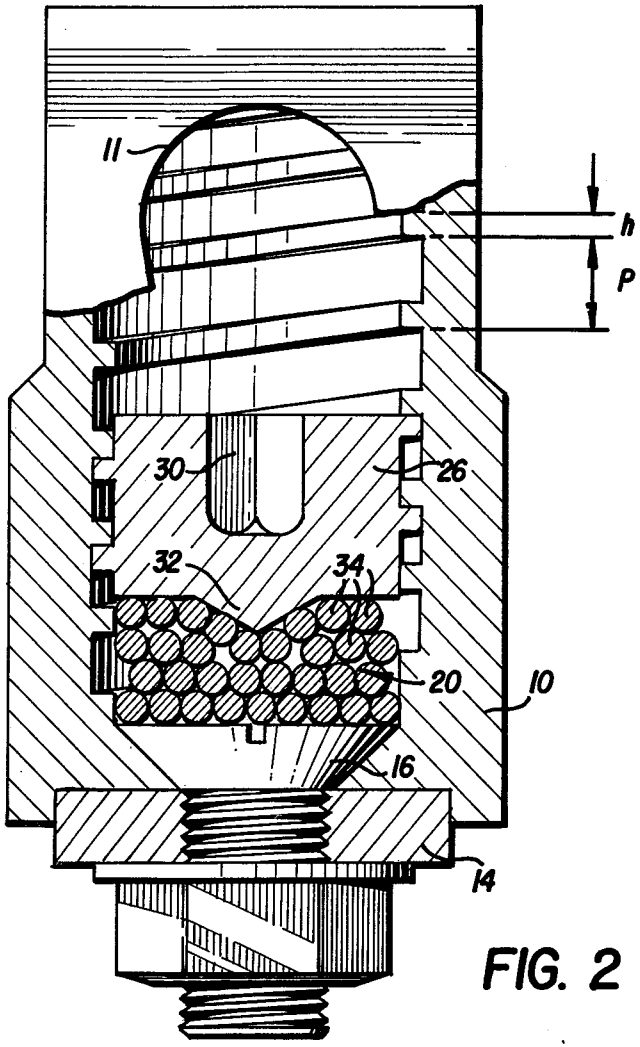
FIG. 2 is a partial section according to the line II—II on FIG. 1, a single cable and the associated setscrew being mounted.
Figure 4:
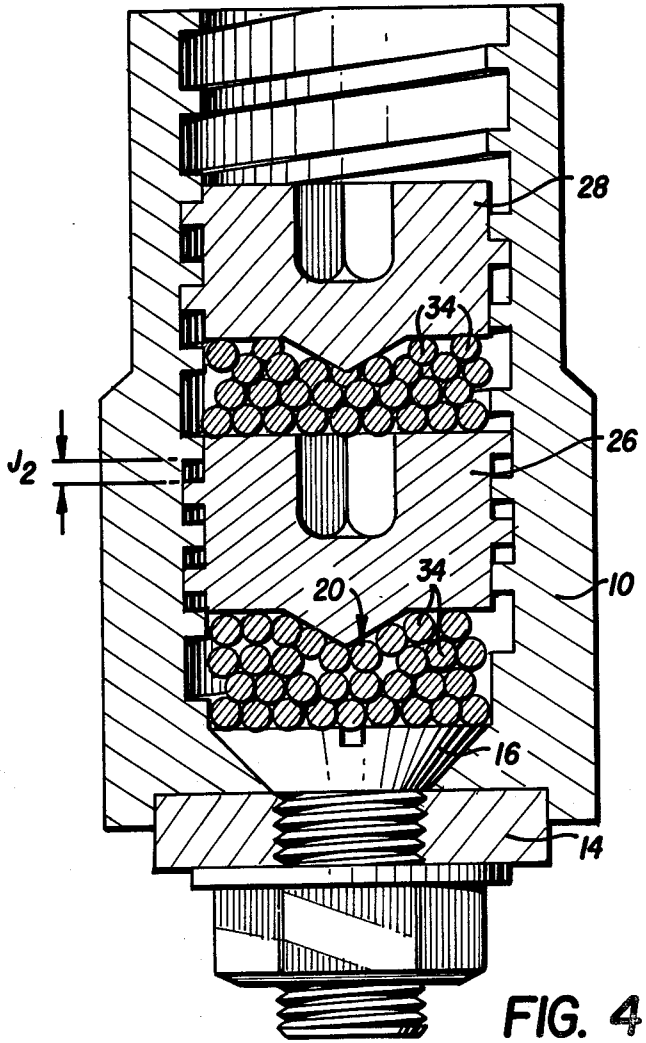
FIGS. 3 and 4 are sections according to the line II—II, showing the terminal after the two cables mounting and after retightening respectively.
Figure 3:
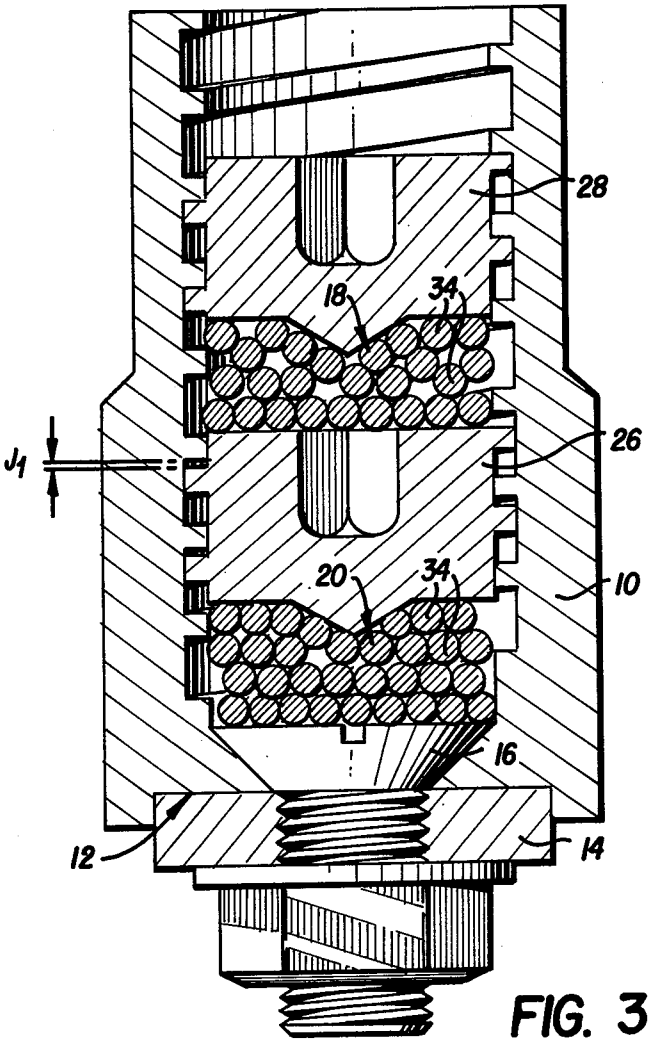

The connection is made in the following way:

The block 10 is fastened on the lug 14 by the bolt 16 inserted through the aperture 22. The end of the lower cable 20 is then inserted through the slot 11 and the intermediate screw 26 is screwed into the tapped hole 22 up to the tightening with compression of the strands 34 of the cable 20 (see FIG. 2). The upper cable 18 is inserted inside the slot 11 above the intermediate screw 26 and tightened by the upper screw 28 screwed inside the tapped hole 22. Referring to FIG. 3, it can be seen that the cable 18 is tightened between the screws 26, 28, and that under the tightening effect the screw 26 has been axially shifted creating a relatively weak play $j_1$ at the level of the threading. After a certain development time during which the apparatus went through repeated thermal cycles and some compression of the cable strands, a retightening is done by causing the upper screw 28 to rotate. The retightening effect is transmitted to the intermediate screw 26 which undergoes an additional sliding resulting in a play $J_2$ of a value superior to the one of play $j_1$. It is easy to understand that the screw 28 rotation ensures a retightening of the two cables 18, 20 owing to the possibility of axial sliding of the intermediate screw 26 (FIG. 4).

As an advantage the block 10 is made of a moulded conducting material and the tapping with play 22 advantageously extends all along the height of the hole. It is clear that the upper screw 28 does not need a mounting with play and that the realization of a terminal inside which only the intermediate screw 26 has the possibility of axially sliding will still be part of the invention. The invention also applies to terminals capable of receiving a greater number of superposed conductors.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. A cable clamp terminal for connecting conducting cables to an electrical apparatus, said terminal comprising a terminal block having an elongated slot that defines two superposed housings, each of said housings being adapted to receive the end of a cable, and a tapped aperture extending generally perpendicular to said slot; and two threaded setscrews adapted to be secured into said tapped aperture, one of said setscrews being an intermediate screw for tightening the cable inserted in the lower housing between the block bottom and the intermediate screw, and the other of said setscrews being an upper screw for tightening the cable inserted in the upper housing between the intermediate screw and the upper screw, wherein the threading of the intermediate screw provides for longitudinal play relative to said tapped aperture, thereby allowing a limited axial sliding of the intermediate screw while fixing the intermediate screw in rotation.

2. A cable clamp terminal according to claim 1, wherein the tapping with play extends along the length of the tapped aperture and cooperates with said two screws.

3. A cable clamp terminal according to claim 1 or 2, wherein the tapped aperture and the screws have square threads, the threads on the screws engaging the threads on the tapped aperture.

* * * * *